US008647084B2

(12) United States Patent
Chang

(10) Patent No.: US 8,647,084 B2
(45) Date of Patent: Feb. 11, 2014

(54) CYLINDER DIVIDING MECHANISM OF A PNEUMATIC TOOL

(75) Inventor: Ching-Shun Chang, Da'an Township, Taichung County (TW)

(73) Assignee: Sing Hua Industrial Co., Ltd., Da'an Township, Taichung County (TW)

( * ) Notice: Subject to any disclaimer, the term of this patent is extended or adjusted under 35 U.S.C. 154(b) by 204 days.

(21) Appl. No.: 13/365,756

(22) Filed: Feb. 3, 2012

(65) Prior Publication Data

US 2013/0202471 A1 Aug. 8, 2013

(51) Int. Cl.

| | |
|---|---|
| ***F03C 2/00*** | (2006.01) |
| ***F01C 21/00*** | (2006.01) |
| ***F03C 4/00*** | (2006.01) |
| ***F04C 2/00*** | (2006.01) |
| ***F04C 15/00*** | (2006.01) |
| ***B23B 45/04*** | (2006.01) |
| ***B27C 3/08*** | (2006.01) |

(52) U.S. Cl.

USPC ..... 418/15; 418/270; 173/169; 173/168; 173/170

(58) Field of Classification Search

USPC ..... 418/70, 82, 3, 6, 15, 270, DIG. 1, 259, 418/266–268; 415/503; 173/168–169

See application file for complete search history.

(56) References Cited

U.S. PATENT DOCUMENTS

| | | | | |
|---|---|---|---|---|
| 2,733,687 | A * | 2/1956 | Schmid | 418/133 |
| 6,880,645 | B2 * | 4/2005 | Izumisawa | 173/93.5 |
| 7,572,119 | B2 * | 8/2009 | Lin | 418/270 |

* cited by examiner

*Primary Examiner* — Thomas Denion
*Assistant Examiner* — Deming Wan
(74) *Attorney, Agent, or Firm* — Egbert Law Offices, PLLC

(57) ABSTRACT

In a cylinder dividing mechanism of a pneumatic tool, the first and second air pressure driving spaces are formed in the chamber, the first and second external channels are set externally on the circumferential wall, the first external channel is connected with the first air intake and air intake/exhaust dividing controller, and the second external channel is connected with the second air intake and air intake/exhaust dividing controller. As such, a single chamber is provided with two air pressure driving spaces for synchronous compression and driving of the rotor. The driving torsion for the pneumatic tool could be multiplied without need of increasing the volume of the chamber of the cylinder to cater for the need of the users with improved applicability.

6 Claims, 9 Drawing Sheets

CYLINDER DIVIDING MECHANISM OF A PNEUMATIC TOOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a pneumatic tool, and more particularly to an innovative one which is designed with a cylinder dividing mechanism.

2. Description of Related Art Including Information Disclosed Under 37 CFR 1.97 and 37 CFR 1.98

The drive system of a pneumatic tool is structurally designed in a way that air pressure is guided into a cylinder to drive the rotation of a vane rotor synchronously with a shaft lever for generating preset actions (e.g.: loosening or locking the bolts).

Generally, a common bias vane is assembled into the cylinder, then a lateral space with larger spacing between the vane and cylinder is taken as a driving space for guiding, compression, expansion and relief of air pressure. Yet, after air pressure is guided into the driving space, a relief port must be set at almost half of the stroke for smooth, continuous rotation of the vane, but the compression stroke of air pressure will be limited, making it difficult to further increase the torsion. Given the fact that the driving torsion of the pneumatic tool depends on the driving force for the vane, it is understood that, if the volume of the cylinder is not increased, the efficient stroke of the vane under air pressure is restricted by the position of the relief port, making it impossible to further increase the stroke and driving torsion (incl.: clockwise and counterclockwise rotation) of the pneumatic tool as a bottleneck in this industry.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the present invention, the first and second air pressure driving spaces are formed in the chamber, the first and second external channels are set externally on the circumferential wall, the first external channel is connected with the first air intake and air intake/exhaust dividing controller, and the second external channel is connected with the second air intake and air intake/exhaust dividing controller, so a single chamber is provided with two air pressure driving spaces for synchronous compression and driving of the rotor. In such a case, the driving torsion for the pneumatic tool could be multiplied without need of increasing the volume of the chamber of the cylinder to cater for the need of the users with improved applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
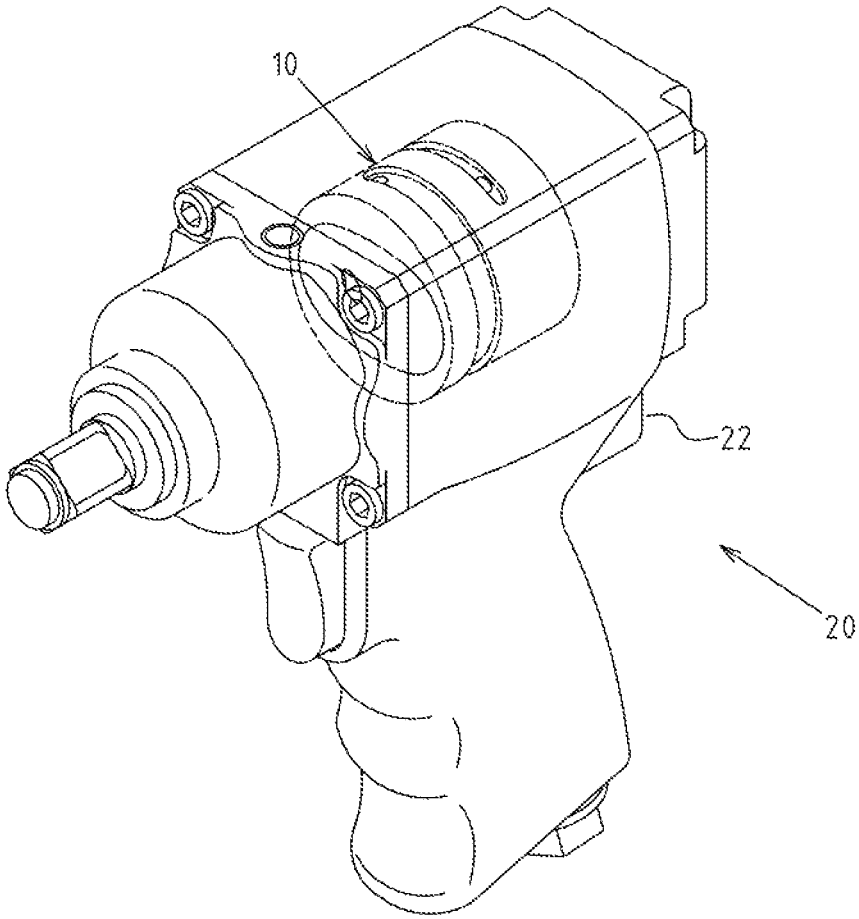
FIG. 1 is a perspective view of a preferred embodiment of the pneumatic tool of the present invention.

FIGS. 1-4 depict preferred embodiments of a cylinder dividing mechanism of pneumatic tool of the present invention, which, however, are provided for only explanatory objective for patent claims. Said cylinder 10 is accommodated in the groove 21 of a pneumatic tool 20 (a pneumatic spanner). Said cylinder 10 comprises of a circumferential wall 11 and an internal chamber 12, of which the chamber 12 is used to hold a rotor 30, onto which several vanes 31 are set circumferentially for abutting onto the circumferential wall 11 of the cylinder 10, thus driving the rotation of the rotor 30 when air pressure is guided.

Figure 5:
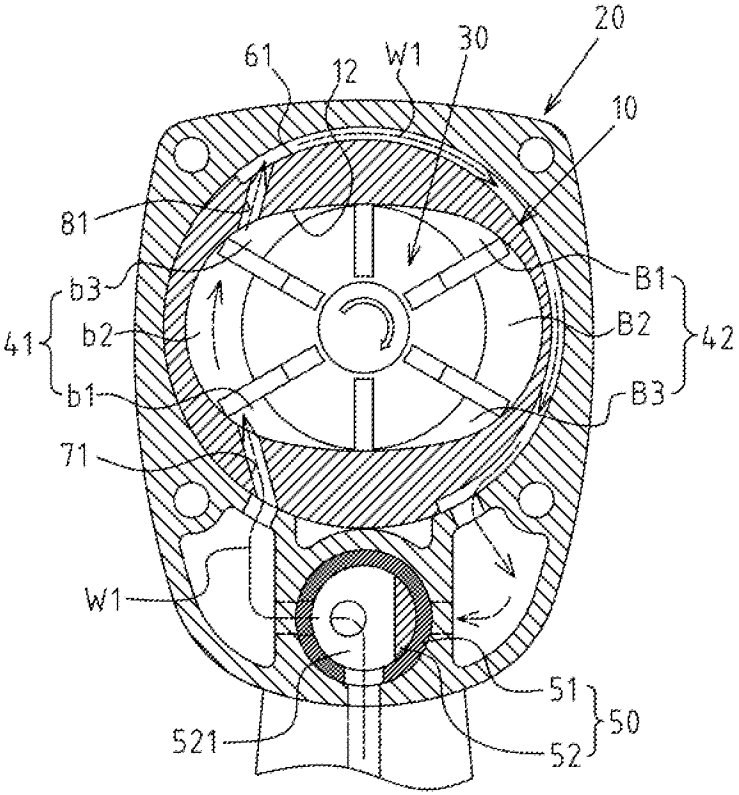
FIG. 5 is a schematic view of the first flow path of the present invention when the rotor is under clockwise driving mode (according to A-A sectional view of FIG. 3).

The core aspect of the present invention comprises the rotor 30 set at a central demarcation point in the chamber 12, such that the chamber 12 is segregated into a first air pressure driving space 41 and a second air pressure driving space 42 (shown in FIG. 5).

Of which, the first and second air pressure driving spaces 41, 42 have an air intake section b1 (B1), a compression section b2 (B2) and a pressure relief section b3 (B3) (shown in FIG. 5).

An air intake/exhaust dividing controller 50 is set externally on the circumferential wall 11 of the cylinder 10 correspondingly to the joint of the first and second air pressure driving spaces 41, 42, so as to switch the operating mode of the pneumatic tool 20 for clockwise or counterclockwise rotation of the rotor 30.

A first external channel 61 and a second external channel 62 are set externally at interval on the circumferential wall 11 of the cylinder 10, and either end of the first/second external channels 61, 62 is connected with the air intake/exhaust dividing controller 50.

A first air intake 71 is set on the circumferential wall 11 of the cylinder 10 and connected with the air intake section b1 of the first air pressure driving space 41 and the air intake/exhaust dividing controller 50.

A first air vent 81 is set on the circumferential wall 11 of the cylinder 10 and connected with the pressure relief section b3 of the first air pressure driving space 41 and the first external channel 61.

A second air intake 72 is set on the circumferential wall 11 of the cylinder 10 and connected with the air intake section B1 of the second air pressure driving space 42 and the second external channel 62.

A second air vent 82 is set on the circumferential wall 11 of the cylinder 10 and connected with the pressure relief section B3 of the second air pressure driving space 42 and the air intake/exhaust dividing controller 50.

Figure 2:
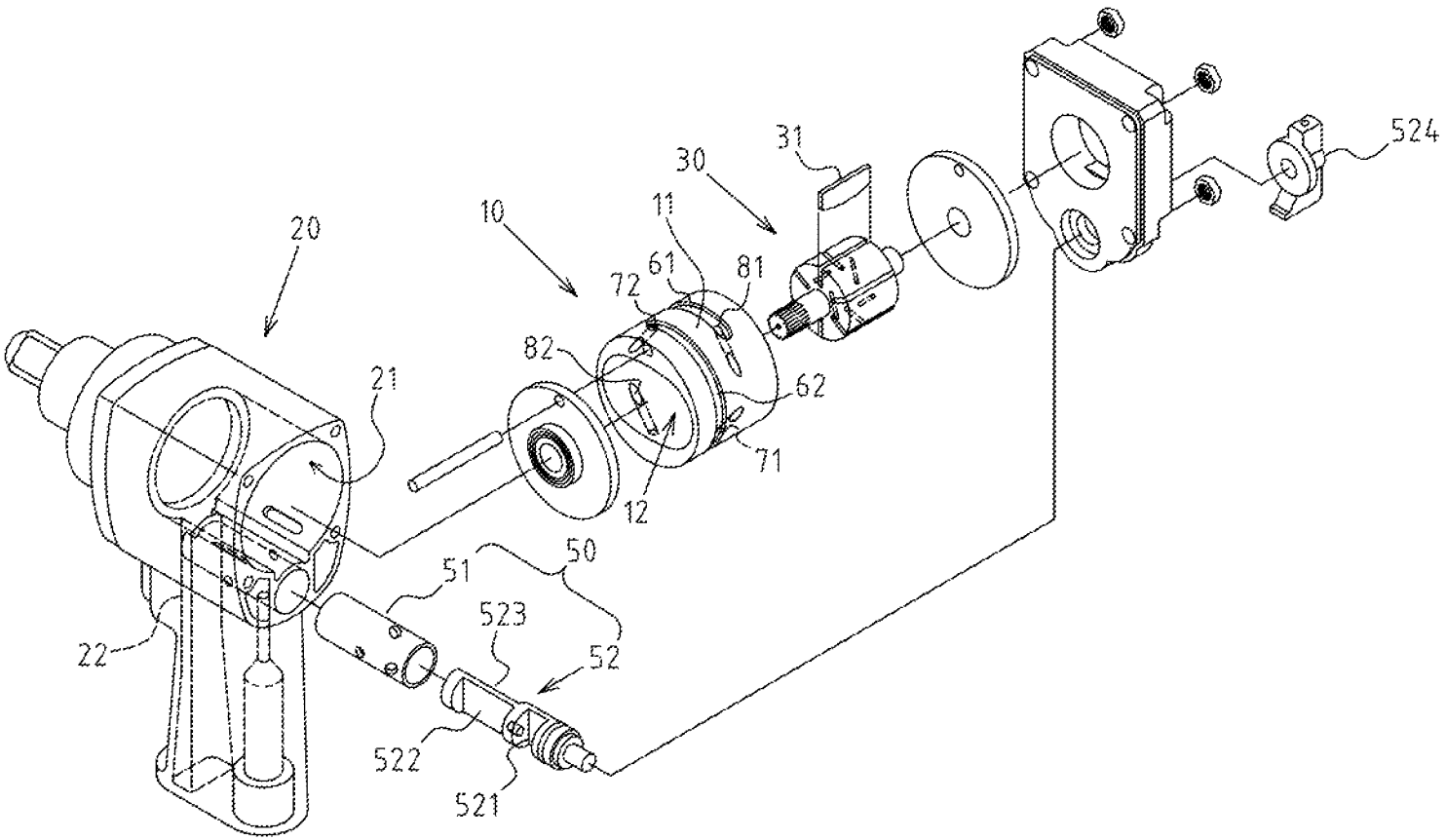
FIG. 2 is an exploded perspective view of a preferred embodiment of the pneumatic tool of the present invention.

Referring to FIG. 2, the air intake/exhaust dividing controller 50 comprises of a valve pipe 51 and a flow path switching valve 52 set rotatably in the valve pipe 51. The flow path switching valve 52 includes an air intake duct 521, an air intake guiding portion 522, an air exhaust guiding portion 523 and a rotary control button 524. A vertical exhaust channel 22 (marked in FIGS. 2, 3) set in the pneumatic tool 20 can be connected vertically with the air exhaust guiding portion 523, such that the first air intake 71 and one end of the second external channel 62 on the circumferential wall 11 are connected with the air intake guiding portion 522, and one end of the first external channel 61 and the second air vent 82 connected with the air exhaust guiding portion 523. Of which, the sectional area of the second external channel 62 is smaller than that of the first external channel 61. When the rotor 30 is under clockwise rotation mode (marked in FIGS. 5, 6), the air pressure thrust of the second air pressure driving space 42 is smaller than that of the first air pressure driving space 41, so as to prevent excessive driving pressure in this mode.

Based upon above-specified structure, the present invention is operated as follows:

Referring to FIG. 5 (in collaboration with FIG. 4), when the pneumatic tool 20 is under an operating mode for driving clockwise the rotor 30, the clockwise stream W1 in the first flow path guided by the air intake/exhaust dividing controller 50 is guided through the first air intake 71 to the first air pressure driving space 41 from an air intake duct 521 of the flow path switching valve 52, such that the rotor 30 is driven. Next, the stream W1 is discharged from the first air vent 81 to the first external channel 61, then guided from the first external channel 61 to the air exhaust guiding portion 523 (shown in FIG. 2) of the flow path switching valve 52, and finally discharged from the exhaust channel 22.

Figure 6:
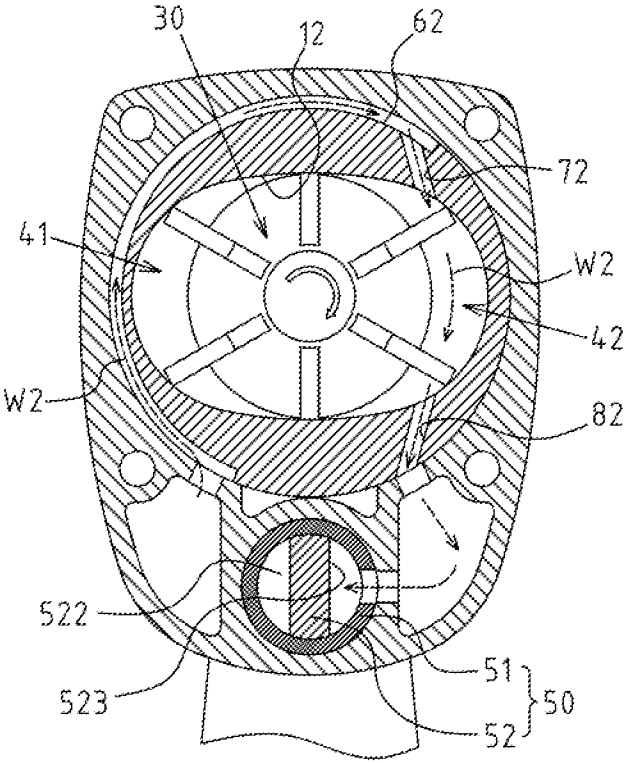
FIG. 6 is a schematic view of the first flow path of the present invention when the rotor is under clockwise driving mode (according to B-B sectional view of FIG. 3).

Referring to FIG. 6 (in collaboration with FIG. 4), the clockwise stream W2 in the second flow path guided by the air intake/exhaust dividing controller 50 is guided from the second external channel 62 to the second air intake 72, and then into the second air pressure driving space 42 for driving the rotor 30. Since the sectional area of the second external channel 62 is smaller than that of the first external channel 61, the thrust of stream W2 for the rotor 30 is smaller. Next, the stream W2 is guided from the second air vent 82 to the air exhaust guiding portion 523 of the flow path switching valve 52, and finally discharged from the exhaust channel 22 (shown in FIG. 2).

Figure 7:
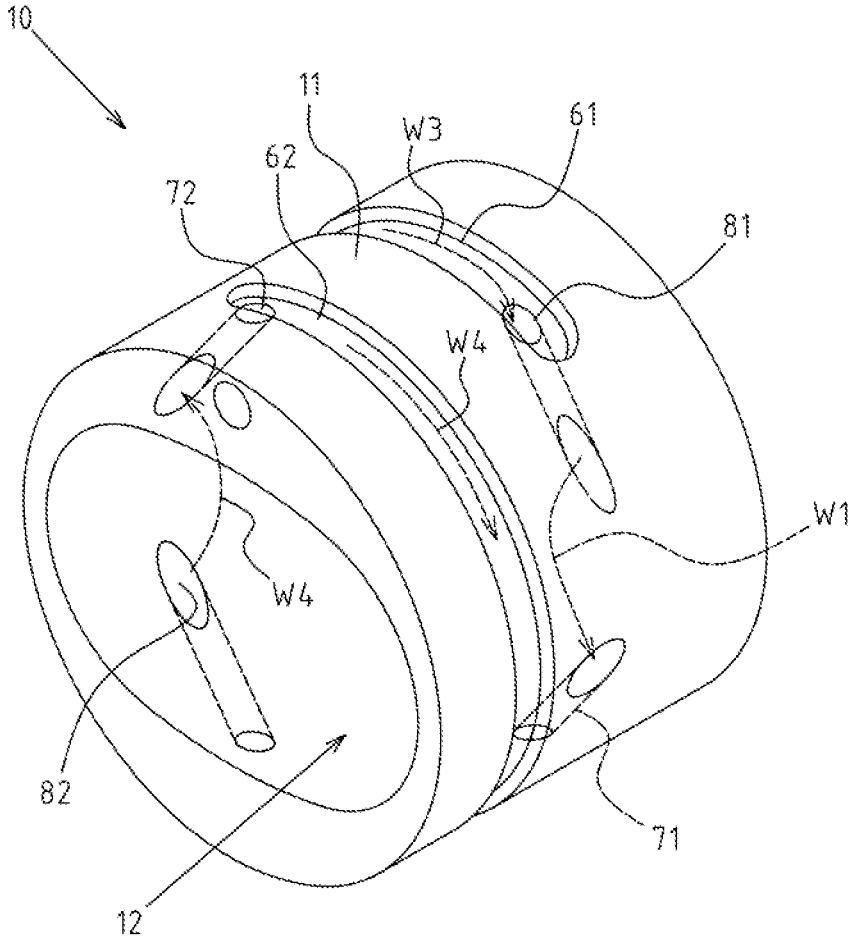
FIG. 7 is an enlarged and counterclockwise flow path view of the cylinder of the present invention.
Figure 8:
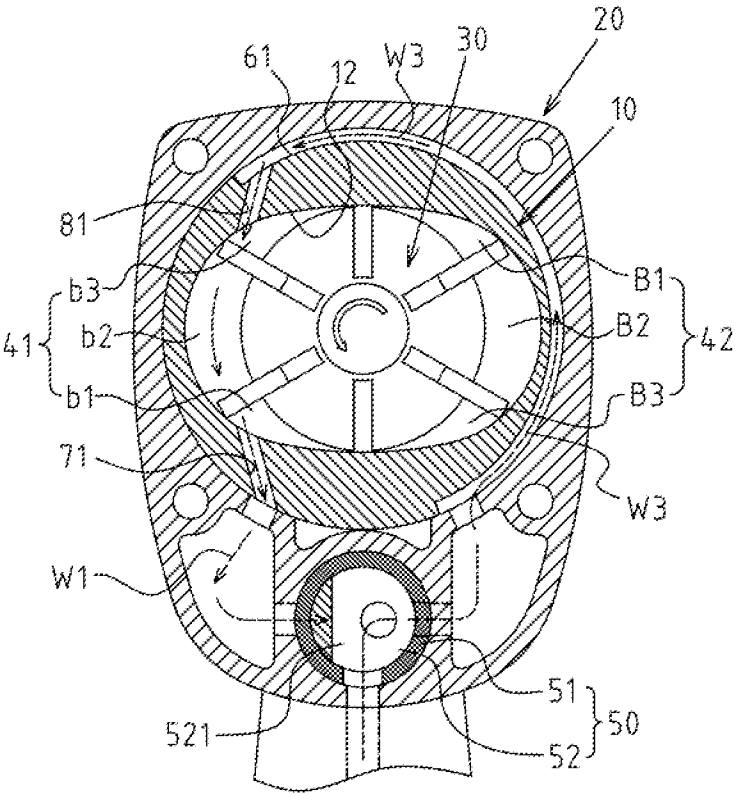
FIG. 8 is a schematic view of the first flow path of the present invention when the rotor is under clockwise driving mode (according to A-A sectional view of FIG. 3).

Referring also to FIG. 8 (in collaboration with FIG. 7), when the pneumatic tool 20 is under an operating mode for driving counterclockwise the rotor 30, the counterclockwise stream W3 in the first flow path guided by the air intake/exhaust dividing controller 50 is guided through the first air vent 81 to the first air pressure driving space 41 from the first external channel 61, such that the rotor 30 is driven counterclockwise. Next, W3 is guided from the first air intake 71 to the air exhaust guiding portion 523 (shown in FIG. 2) of the flow path switching valve 52, and finally discharged from the exhaust channel 22.

Figure 9:
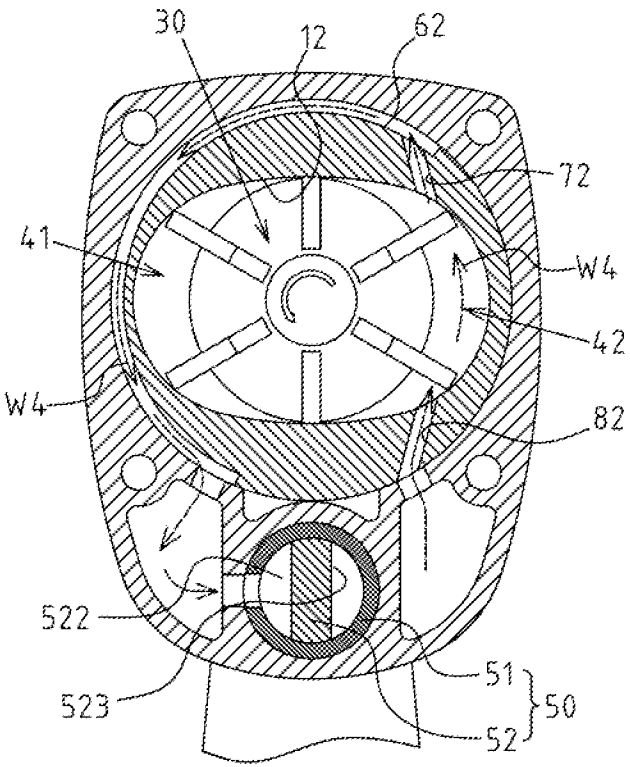
FIG. 9 is a schematic view of the first flow path of the present invention when the rotor is under clockwise driving mode (according to B-B sectional view of FIG. 3).

Referring also to FIG. 9 (in collaboration with FIG. 7), the counterclockwise stream W4 in the second flow path guided by the air intake/exhaust dividing controller 50 is guided from the second air vent 82 to the second air pressure driving space 42 for driving the rotor 30 for counterclockwise rotation, then from the second air intake 72 to the second external channel 62 and furthermore to the air exhaust guiding portion 523 of the flow path switching valve 52, and finally discharged from the exhaust channel 22 (shown in FIG. 2). With such a design, a single chamber is provided with two air pressure driving spaces for synchronous compression and driving of the rotor 30, so the driving torsion for the rotor 30 and the pneumatic tool could be multiplied without need of increasing the volume of the chamber 12 of the cylinder 10.

Figure 3:
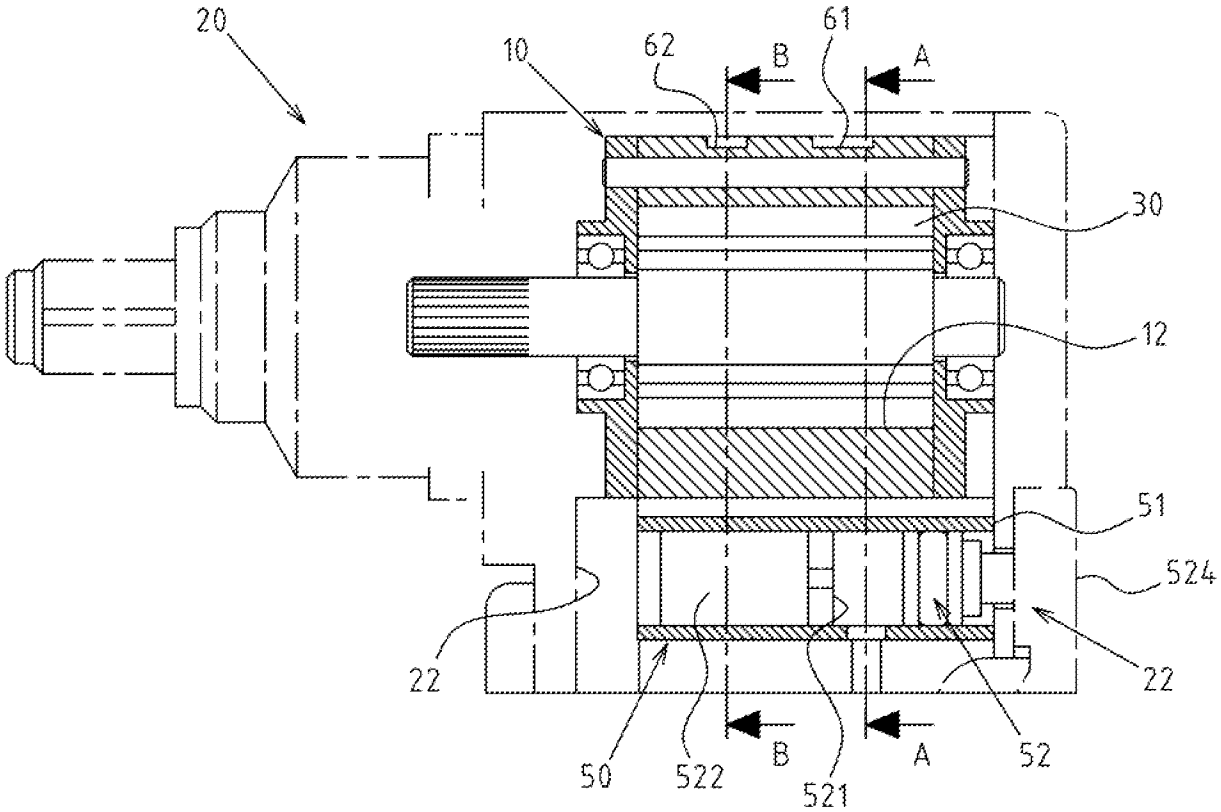
FIG. 3 is a partially assembled sectional view of a preferred embodiment of the pneumatic tool of the present invention (along the axial direction of the rotor).
Figure 4:
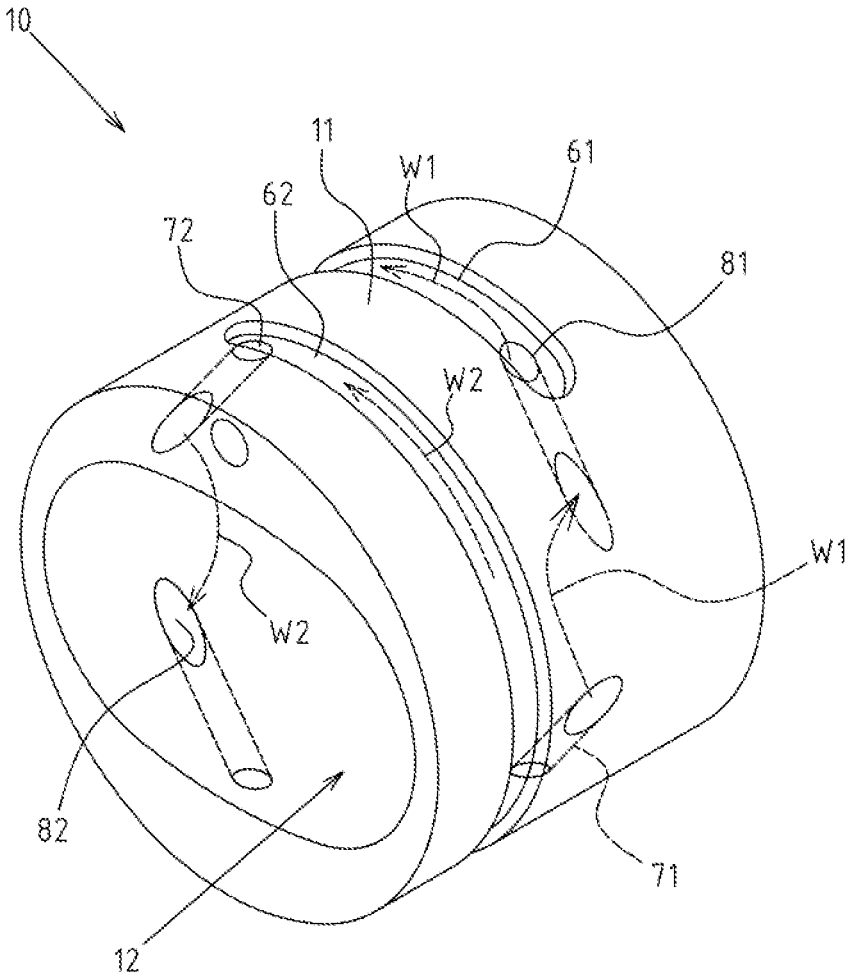
FIG. 4 is an enlarged and clockwise flow path view of the cylinder of the present invention.

Referring to FIG. 3, the first and second external channels 61, 62 are formed by circumferential troughs set at interval externally on the circumferential wall 11 of the cylinder 10. In addition, the first and second external channels 61, 62 are also formed by circumferential troughs set at interval on the groove 21 of the pneumatic tool 20 as a preferred embodiment.

Figure 10:
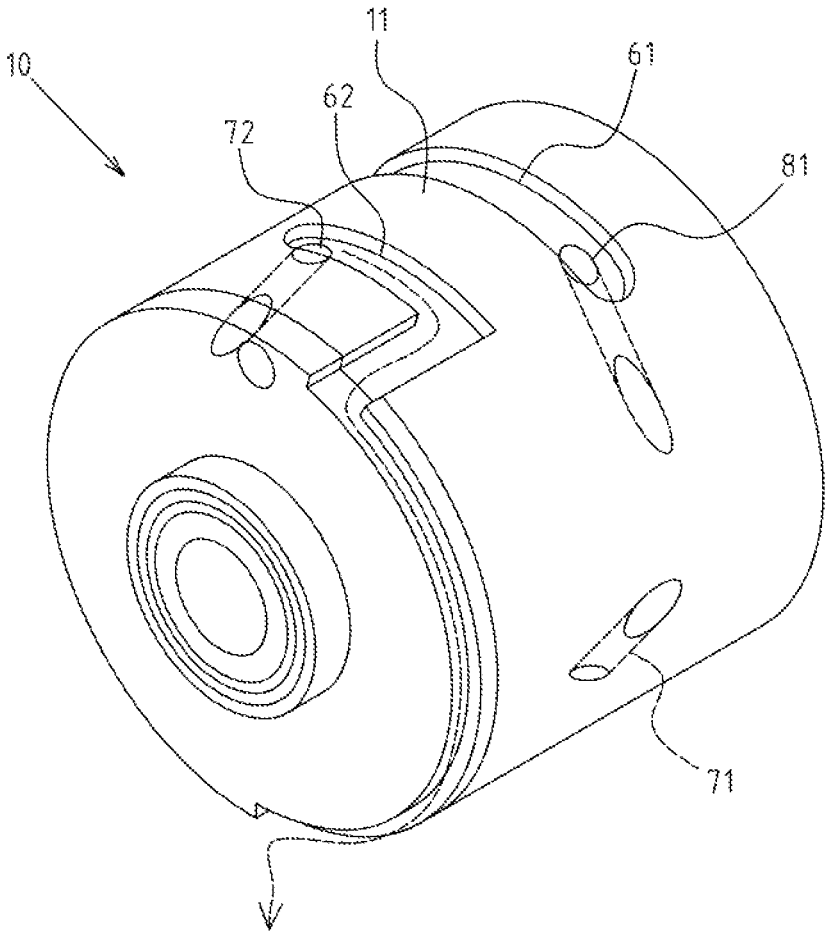
FIG. 10 is a perspective view of a preferred embodiment of the present invention wherein one end of the second external channel is directly connected with the exhaust channel of the pneumatic tool.
Figure 11:
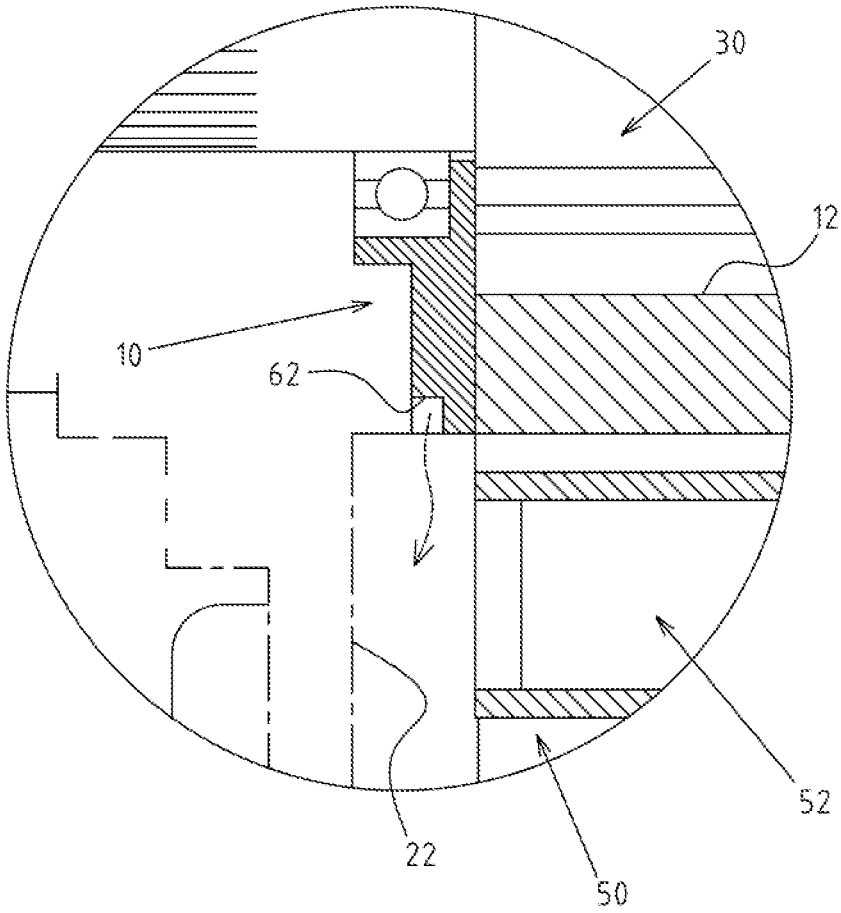
FIG. 11 is a sectional view of a preferred embodiment of the present invention wherein one end of the second external channel is directly connected with the exhaust channel of the pneumatic tool.

Referring also to FIGS. 10 and 11, one end of the second external channel 62 is directly connected with the exhaust channel 22 of the pneumatic tool 20 (not through the flow path switching valve 52). With this design, when the rotor 30 is under clockwise rotation mode, air pressure thrust is guided only by the first air pressure driving space 41. When the rotor is under counterclockwise rotation mode, air pressure thrust is guided synchronously by the first and second air pressure driving spaces 41, 42 for compression and driving of the rotor 30 as a preferred embodiment.

I claim:

1. A cylinder dividing mechanism of a pneumatic tool, which is accommodated in the groove of the pneumatic tool; the cylinder comprises of a circumferential wall and an internal chamber, of which the chamber is used to hold a rotor, onto which several vanes are set circumferentially for abutting onto the circumferential wall of the cylinder; it comprising:

the rotor is set at a central demarcation point in the chamber, such that the chamber is segregated into a first and a second air pressure driving space;

of which, the first and second air pressure driving spaces have an air intake section, a compression section and a pressure relief section;

an air intake/exhaust dividing controller is set externally on the circumferential wall of the cylinder correspondingly to the joint of the first and second air pressure driving spaces;

a first and a second external channel are set externally at interval on the circumferential wall of the cylinder, and either end of the first/second external channels is connected with the air intake/exhaust dividing controller;

a first air intake is set on the circumferential wall of the cylinder and connected with the air intake section of the first air pressure driving space and the air intake/exhaust dividing controller;

a first air vent is set on the circumferential wall of the cylinder and connected with the pressure relief section of the first air pressure driving space and the first external channel;

a second air intake is set on the circumferential wall of the cylinder and connected with the air intake section of the second air pressure driving space and the second external channel;

a second air vent is set on the circumferential wall of the cylinder and connected with the pressure relief section of the second air pressure driving space and the air intake/exhaust dividing controller;

when air stream is guided by the air intake/exhaust dividing controller, it is divided and guided by two air intakes, air vents and external channels, such that a single chamber is provided with two air pressure driving spaces for synchronous compression and driving of the rotor to increase the torsion for the pneumatic tool.

2. The structure defined in claim 1, wherein the first and second external channels are formed by circumferential troughs set at interval externally on the circumferential wall of the cylinder.

3. The structure defined in claim 1, wherein the first and second external channels are also formed by circumferential troughs set at interval on the groove of the pneumatic tool.

4. The structure defined in claim 1, wherein if air stream is guided counterclockwise by the air intake/exhaust dividing controller, air intake/exhaust of the first air intake and first air vent is exchanged in the same way as the second air intake and second air vent.

5. The structure defined in claim 1, wherein said air intake/exhaust dividing controller comprises of a valve pipe and a flow path switching valve set rotatably in the valve pipe; the flow path switching valve includes an air intake duct, an air intake guiding portion, an air exhaust guiding portion and a rotary control button; an exhaust channel set in the pneumatic tool can be connected with the air exhaust guiding portion, such that the first air intake and one end of the second external channel on the circumferential wall are connected with the air intake guiding portion, and one end of the first external channel and the second air vent connected with the air exhaust guiding portion; of which, the sectional area of the second external channel is smaller than that of the first external channel; when the rotor is under clockwise rotation mode, the air pressure thrust of the second air pressure driving space is smaller than that of the first air pressure driving space.

6. The structure defined in claim 1, wherein said air intake/exhaust dividing controller comprises of a valve pipe and a flow path switching valve set rotatably in the valve pipe; the flow path switching valve comprises an air intake duct, an air intake guiding portion, an air exhaust guiding portion and a rotary control button; an exhaust channel set in the pneumatic tool can be connected with the air exhaust guiding portion, such that one end of the second external channel is connected directly with the exhaust channel, the first air intake of the circumferential wall is connected with the air intake guiding portion, and one end of the first external channel and the second air vent are connected with the air exhaust guiding portion; when the rotor is under clockwise rotation mode, air pressure thrust is guided only by the first air pressure driving space; when the rotor is under counterclockwise rotation mode, air pressure thrust is guided synchronously by the first and second air pressure driving spaces for compression and driving of the rotor.

* * * * *